United States Patent [19]

Theodore

[11] 4,269,662

[45] May 26, 1981

[54] APPARATUS FOR COMPACTING, DEGASSING AND CARBONIZING CARBONACEOUS AGGLOMERATES

[75] Inventor: Frank W. Theodore, Pittsburgh, Pa.

[73] Assignee: Conoco, Inc., Stamford, Conn.

[21] Appl. No.: 99,773

[22] Filed: Dec. 3, 1979

Related U.S. Application Data

[62] Division of Ser. No. 11,724, Feb. 12, 1979, Pat. No. 4,218,288.

[51] Int. Cl.[3] ..... C10B 1/10; C10B 49/20

[52] U.S. Cl. ..... 202/100; 202/131

[58] Field of Search ..... 201/3, 6, 5, 12, 32, 201/33; 202/100, 131, 136, 216, 218; 44/10 R, 10 J, 10 K, 10 L

[56] References Cited

U.S. PATENT DOCUMENTS

| | | | |
|---|---|---|---|
| 2,654,698 | 10/1953 | Phinney | 201/3 X |
| 2,843,533 | 7/1958 | Smith et al. | 201/5 |
| 3,700,564 | 10/1972 | Willibald et al. | 201/6 |
| 4,050,990 | 9/1977 | Lorenz | 201/6 X |

*Primary Examiner*—Frank W. Lutter
*Assistant Examiner*—Roger F. Phillips
*Attorney, Agent, or Firm*—F. Lindsey Scott; William A. Mikesell, Jr.

[57] ABSTRACT

An apparatus for compacting, degassing and carbonizing carbonaceous agglomerates, the apparatus comprising a rotary kiln having an agglomerate inlet means for introducing green agglomerates into the kiln near the inlet of the kiln and a heating medium inlet for introducing a heating medium comprising a finely divided solid into the kiln at a preselected location intermediate the inlet end of the kiln and the outlet end of the kiln to produce a mixture at a temperature above the carbonizing temperature of the agglomerates and a sieve positioned to receive the products from the rotary kiln and separate the heating medium and the compacted, degassed, carbonized agglomerate product. A method for producing compacted, degassed, carbonized carbonaceous agglomerates by the use of the apparatus is also disclosed.

3 Claims, 3 Drawing Figures

APPARATUS FOR COMPACTING, DEGASSING AND CARBONIZING CARBONACEOUS AGGLOMERATES

This is a division of application Ser. No. 011,724, filed Feb. 12, 1979, now U.S. Pat. No. 4,218,288.

This invention relates to a method and an apparatus for compacting, degassing and carbonizing carbonaceous agglomerates.

In the operation of blast furnaces, large amounts of metallurgical grade coke are required. Such coke is produced by coking blends of carefully selected coals to produce metallurgical coke in coke ovens. As a result of the expense of such carefully preselected coal blends and the environmental problems created by the operation of such coke ovens, a continuing search has been directed to methods for producing coke in ways which do not result in environmental pollution and which can use a broader range of coal feedstocks. A number of such methods are shown in the following U.S. Patents which are hereby incorporated in their entirety by reference.

U.S. Pat. No. 3,073,751
U.S. Pat. No. 3,671,401
U.S. Pat. No. 3,368,012
U.S. Pat. No. 3,748,254
U.S. Pat. No. 3,401,089
U.S. Pat. No. 3,988,114
U.S. Pat. No. 3,460,195
U.S. Pat. No. 4,008,054
U.S. Pat. No. 3,562,783
U.S. Pat. No. 4,030,982
U.S. Pat. No. 4,046,496

These references are generally directed to processes wherein coal is combined with coal-derived solids and optionally a binder as a feedstock to a rotary kiln wherein the feedstock is tumbled to produce agglomerate products which are discharged to a calciner or the like to produce coke. It has been found that when such processes are used, a wide size consist product is produced. Since it is desirable that the product size consist for use as metallurgical grade coke be from about ¾" to about 3", it is clear that improved operation could be accomplished if a more uniform size consist could be produced. Numerous attempts to achieve such an improved size consist have been made by briquetting, extruding or otherwise forming coaly materials into agglomerates and thereafter attempting to degas and calcine the formed particles. Such attempts have been only limitedly successful, because the particles do not exhibit suitable strength for use as metallurgical coke after degassing and calcining. While such particles may, in some instances, be suitable as a feedstock to fixed bed gasifiers and the like, they are not suitable for use as metallurgical coke. As a result, a continuing search has been directed to the development of new methods whereby carbonized agglomerates of a relatively uniform size consist having a high strength can be produced for use as a metallurgical coke.

It has now been found that carbonaceous agglomerates can be effectively compacted, degassed, and carbonized in an apparatus comprising a rotary kiln positioned to facilitate the movement of the agglomerates through the kiln wherein the kiln includes means for introducing the agglomerates near the inlet end and a heating medium inlet for introducing a heating medium at a preselected location intermediate the inlet end of the kiln and the outlet end of the kiln to produce a mixture of heating medium and agglomerates at a temperature above the carbonizing temperature of the agglomerates so that the mixture can be retained in the kiln for a suitable period of time to produce compacted, degassed, and carbonized agglomerates. A sieve means or the like is positioned to receive products from the kiln and separate the heating medium from the compacted, degassed, carbonized agglomerate products.

Figure 1:
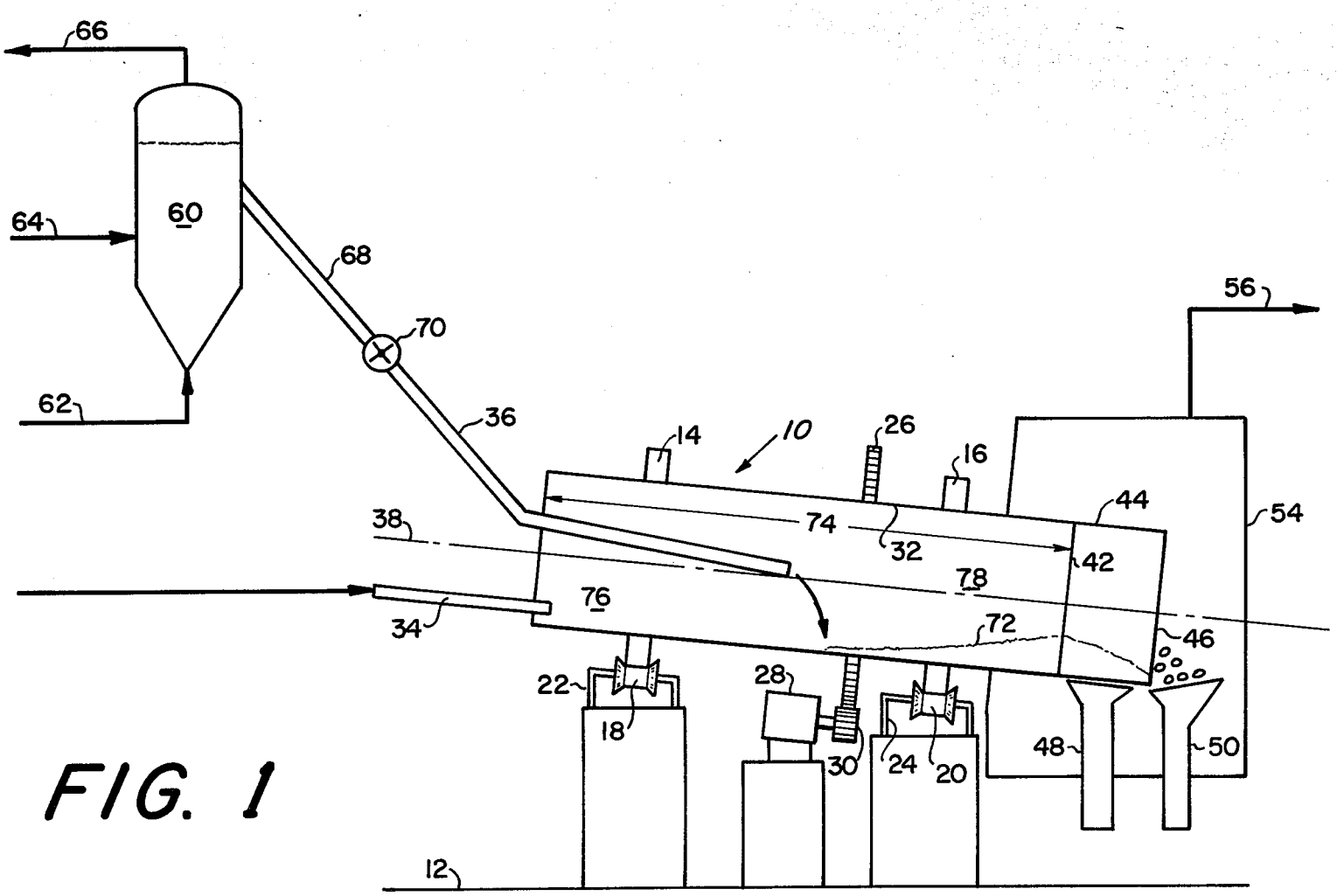
FIG. 1 is a schematic drawing of the apparatus of the present invention.
Figure 2:
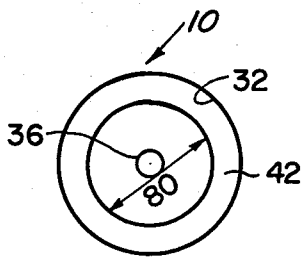
FIG. 2 is an end view of a control means positioned at the outlet end of the kiln to control the residence time of material in the kiln.

In FIG. 1, a rotary retort or kiln generally designated by the number 10 is shown. The kiln is generally cylindrical in shape and rotatably supported in an inclined plane relative to a floor 12. The external wall of the kiln 10 has a pair of annular bearing rings 14 and 16 secured thereto for rotatably supporting kiln 10 on a pair of bearings 18 and 20 which are journaled in fixed supports 22 and 24. An annular gear 26 encircles kiln 10 and is secured thereto for rotation therewith. A motor 28 having a gear 30 meshing with annular gear 26 is arranged to rotate kiln 10 at a preselected speed and in a preselected direction. Kiln 10 has an inner cylindrical surface 32 and includes an agglomerate inlet 34 and a heating medium inlet 36. Kiln 10 has a longitudinal axis 38 which is inclined slightly from the horizontal to facilitate the flow of agglomerate materials through kiln 10. Typically, longitudinal axis 38 is inclined at no more than 10 degrees from horizontal, although in some instances it may be desirable to use higher angles. The primary criterion in the selection of the inclination of longitudinal axis 38 is the residence time in kiln 10. A level control means 42 is positioned at the outlet end of kiln 10 to control the residence time of material in kiln 10. A screen 44 is positioned to receive material from rotary kiln 10 after it passes level control means 42 and separate fine solids such as the heating medium, any attrited carbonaceous agglomerate material and the like from the agglomerate product. The fine solids are recovered in a fine solids receiver 48. A larger solids receiver 50 is provided for receiving the compacted, degassed, carbonized agglomerate product. A seal 54 is positioned about the outlet end 46 of rotary kiln 10. Rotary kiln 10 generally is sealed so that gases emitted from the agglomerates in rotary kiln 10 can be collected. Further, it is desirable to maintain a slight positive pressure in rotary kiln 10 in order that a non-oxidizing atmosphere may be maintained in kiln 10. Accordingly, kiln 10 is sealed as required to maintain control of the gaseous composition in kiln 10. Gas is withdrawn as required to maintain the desired pressure in kiln 10 via a line 56 and passed to further processing. The gases recovered via line 56 will typically contain tars, light carbonaceous materials and the like and can be processed, used for fuel or the like as known to those skilled in the art. The heating medium recovered from fine solids receiver 48 is desirably recycled to a heating medium means for reheating and recycling to rotary kiln 10. The heating means is shown in FIG. 1 as a fluidized bed 60 having an air inlet 62 and a recycle heating medium inlet 64. Attrited carbonaceous materials from the agglomerates and optionally additional fuel are combusted in fluidized bed 60 to produce a flue gas, which is recovered through a flue gas outlet 66, and heat the heating medium contained in fluidized bed 60. The heated heating medium is removed from fluidized bed 60 via a heating medium outlet 68 and passed to a control 70, which is typically a rotary feeder or the like, for recycle to rotary kiln 10 via line 36 are required. A level 72 is maintained in rotary kiln 10 by level control means 42 which is shown in greater detail in FIG. 2. Level control means 42 comprises a weir having an inner diameter 80 positioned substantially around the inner cylindrical surface 32 of rotary kiln 10. The height of the level control means is desirably no more than about ¼ the inner diameter of rotary kiln 10. The weir shown serves to hold up the solids contained in rotary kiln 10 to provide a desired residence time. By adjustment of the height of the weir a desired residence time can be obtained.

Figure 3:
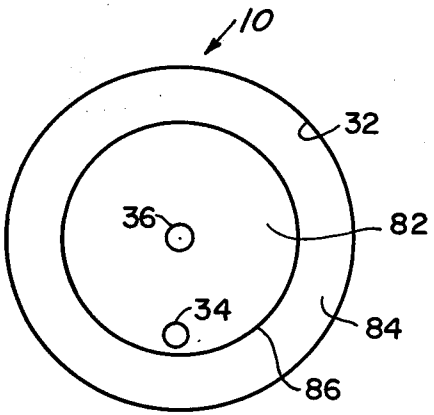
FIG. 3 is an end view of the inlet end of the rotary kiln.

In FIG. 3, an end view of the inlet end of rotary kiln 10 is shown. A fixed section 82 is positioned in the inlet end of rotary kiln 10 and is sealingly joined to the end surface 84 of the inlet end of rotary kiln 10. Section 82 is rotatable relative to section 84 and contains agglomerate inlet 34 and heating medium inlet 36.

Heating medium inlet 36 as shown in FIG. 1, is adapted to inject heating medium at a selected position along the length 74 of rotary kiln 10. In a first portion 76 of rotary kiln 10, generally defined as that portion of rotary kiln 10 upstream of the heated medium injection point, the green agglomerates are subjected to rotational tumbling at substantially their injection temperature. In a second portion 78 of rotary kiln 10, the agglomerates are mixed with the injected heating medium and tumbled at an elevated temperature defined by the mixture of the heating medium and the green agglomerates. The time in first portion 76 and second portion 78 is readily varied by moving the point at which the heating medium is injected either toward the inlet end of rotary kiln 10 or the outlet end of rotary kiln 10. It is not anticipated that the injection point will be moved frequently, but rather that the point at which injection of the heating medium is desired will be determined for each particular feedstock and will remain relatively constant while such feedstock is used. While such is the preferred operation, it is clear that the point at which the heating medium is injected could be varied frequently.

In the operation of the apparatus shown in FIG. 1, green agglomerates which can be produced by a variety of techniques such as rotary kilns, extrusion, pelletizing or the like, are charged to the inlet end of rotary kiln 10 via an inlet 34. When extrusion, briquetting or the like is used, it is desirable that the pellets be discharged directly into the inlet end of rotary kiln 10 in order that heat losses may be avoided. The operation of rotary kiln 10 is substantially adiabatic with all the heat supplied to the materials in the kiln being supplied by the inlet streams. As indicated previously, the atmosphere in rotary kiln 10 is non-oxidizing. A slight positive pressure is maintained in rotary kiln 10 to prevent air leaks into the kiln. In some instances, the green agglomerates produced by extrusion, briquetting or the like may tend to be sticky and ball together unless preventive means are used. Such means are known to those skilled in the art and may comprise the use of a slight cooling prior to injecting the materials into the inlet end of rotary kiln 10, the use of a flash oxidizing step to oxidize the surface of the green agglomerates or the like. In many instances, it is expected that no such treatment will be necessary and that the agglomerates as produced can be passed directly into rotary kiln 10. In rotary kiln 10, the pellets are subjected to rotational tumbling at substantially the inlet temperature. Such rotational tumbling compacts and degasses the pellets. In other words, many of the components required in the pelletizing, briquetting or the like are volatile constituents of the agglomerate particle and, if allowed to escape without continuous compacting of the agglomerate particle, tend to weaken the particle. In the present method, the particles are continuously compacted by the tumbling action as the gaseous materials are allowed to escape.

Desirably, the tumbling in first portion 76 is at a temperature below the carbonizing temperature of the agglomerate materials, but not more than 100° F. below the carbonization temperature of the agglomerates. The carbonization temperature as used herein is defined as that temperature at which the agglomerate particles change from substantially thermo-plastic in nature to thermo-setting in nature. In other words, the particles treated below the carbonizing temperature remain soft upon heating and will re-soften if re-heated after cooling. After carbonizing, the particles will not soften upon further heating but rather volatilize, burn or otherwise decompose without softening. This temperature is obviously not a single specific temperature for all carbonaceous materials or even those produced from common feedstocks, but rather defines a relatively narrow range during which the transition occurs. The carbonization transition is affected by a number of factors such as temperature and time. In other words, carbonization may be accomplished at lower temperatures over long periods of time or over very short periods of time at higher temperatures. For purposes of the present invention, the carbonization temperature is that temperature at which substantially complete transition of the agglomerates from a thermo-plastic material to a thermo-setting material occurs within a time no greater than about 15 minutes.

The agglomerates as indicated are tumbled in first section 76 for a period of time effective to compact and degas the particles. Such a time is typically from about 1 to about 15 minutes. The particles are then mixed with the injected heating medium which is at a temperature sufficient to provide a mixture of heating medium and agglomerate particles having a temperature in excess of the carbonization temperature of the agglomerates. The agglomerates and heating medium are tumbled in second portion 78 of rotary kiln 10 to carbonize and continue to compact to some extent the agglomerate particles. The compacted, degassed, carbonized agglomerate particles are recovered from rotary kiln 10 as indicated. The heating medium is desirably smaller in size than the agglomerates charged to rotary kiln 10 and is easily separated by sieving or the like. While sieving is shown as the desired means of separation in FIG. 1, other means could be used so long as an effective separation is accomplished. Normally, some losses of agglomerate particles by attrition and the like will occur and such fine particles are normally recovered with the heating medium for recycle to fluidized bed 60. The heating medium obviously can be selected from a wide variety of materials with the main requisite being that it be an effective heat transfer material which is thermally stable at the temperatures involved. Inorganic material such as sand or the like could be used as carbonaceous materials such as char and the like could be used. In any event, the material is desirably heated and recycled to rotary kiln 10 repeatedly. In the embodiment shown, the heating is accomplished by the combustion of the attrited carbonaceous material in the fluidized bed 60.

Desirably, the operating temperature in second zone 78 is above the carbonization temperature of the agglomerates. Such temperatures are typically from about 700° to about 1000° F. and desirably the time in second section 78 is from about 1 to about 15 minutes. Longer times can be used both in first section 76 and second section 78; however, it is desirable that the time be less than 15 minutes in each section to minimize the attrition of the agglomerate particles as they pass through rotary kiln 10. Obviously, higher temperatures can be used in second section 78 if desired. Lower temperatures can be used in first section 76 in the event that agglomerates produced by the use of coal extract materials or the like are used. Such variations and modifications are within the skill of those in the art and form no part of the present invention. The compacted, degassed, carbonized agglomerates produced by the use of the present method are suitable for further calcining and use as metallurgical coke feedstocks. The present method compacts and degasses the agglomerate particles in such a way that the strength of the particles is retained and carbonizes the agglomerate particles in such a way that the strength is retained. Agglomerate particles of carbonaceous materials produced by various processes such as extrusion, briquetting, and the like are effectively compacted, degassed and carbonized to produce metallurgical coke feedstocks.

Having described the invention by reference to certain of its preferred embodiments, it is pointed out that many variations and modifications are possible within the scope of the present invention and it is expected that many such variations and modifications may appear obvious and desirable to those skilled in the art based upon a review of the foregoing description of preferred embodiments.

Having thus described the invention, I claim:

1. An apparatus for compacting, degassing and carbonizing carbonaceous agglomerates, said apparatus comprising:

(a) a rotary kiln, said kiln having an inlet end, an outlet end and a longitudinal axis, said axis being oriented to facilitate the movement of said agglomerates through said kiln;

(b) means for rotatably supporting said kiln;

(c) means for rotating said kiln;

(d) an agglomerate inlet means for introducing said agglomerates into said kiln near said inlet end of said kiln;

(e) a heating medium inlet means for introducing a heating medium into said kiln at a selected location between said inlet end of said kiln and said outlet end of said kiln, said heating medium being introduced at said location to provide a compacting and degassing time in the section of said kiln between said inlet end and said location from about 1 to about 15 minutes and a carbonizing time between said location and said outlet end from about 1 to about 15 minutes;

(f) control means positioned at said outlet end of said kiln to control the residence time of material in said kiln; and (g) sieve means positioned to receive the products from said kiln and separate said heating medium and compacted, degassed, carbonized agglomerate product.

2. The apparatus of claim 1 wherein said control means positioned at said outlet end of said kiln comprises a weir circumferentially positioned around the inner diameter of said kiln near said outlet end.

3. The apparatus of claim 2 wherein said weir has a height up to 0.25 times the inner diameter of said kiln.

* * * * *

UNITED STATES PATENT OFFICE

CERTIFICATE OF CORRECTION

PATENT NO. : 4,269,662

DATED : May 26, 1981

INVENTOR(S) : Frank W. Theodore

It is certified that error appears in the above-identified patent and that said Letters Patent are hereby corrected as shown below:

Column 3, line 6 "are" should read --as--

Column 4, line 66 "as" should read --or--

Signed and Sealed this

*Twenty-fifth* Day of *August 1981*

[SEAL]

*Attest:*

GERALD J. MOSSINGHOFF

*Attesting Officer*

*Commissioner of Patents and Trademarks*